US007075486B2

(12) United States Patent
Suzuki

(10) Patent No.: US 7,075,486 B2
(45) Date of Patent: Jul. 11, 2006

(54) CIRCULARLY POLARIZED WAVE ANTENNA MADE OF SHEET METAL WITH HIGH RELIABILITY

(75) Inventor: Tomotaka Suzuki, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/984,048

(22) Filed: Nov. 9, 2004

(65) Prior Publication Data

US 2005/0099340 A1 May 12, 2005

(30) Foreign Application Priority Data

Nov. 12, 2003 (JP) ..... 2003-382705
Feb. 16, 2004 (JP) ..... 2004-038450

(51) Int. Cl.
*H01Q 1/38* (2006.01)

(52) U.S. Cl. ..... 343/700 MS; 343/846

(58) Field of Classification Search ..... 343/700 MS, 343/702, 846, 848; H01Q 1/38
See application file for complete search history.

(56) References Cited

U.S. PATENT DOCUMENTS 5,831,578 A 11/1998 Lefevre
6,897,813 B1 * 5/2005 Higasa ..... 343/700 MS
2001/0020920 A1 9/2001 Shigihara
2003/0132885 A1 * 7/2003 Kuramoto et al. ..... 343/702
2004/0021606 A1 * 2/2004 Shigihara ..... 343/700 MS
2005/0093748 A1 * 5/2005 Yuanzhu ..... 343/700 MS

FOREIGN PATENT DOCUMENTS

| | | |
|---|---|---|
| DE | 197 22 506 | 12/1998 |
| EP | 1 069 646 | 1/2001 |
| EP | 1 381 111 | 1/2004 |
| JP | 2000-151261 | 5/2000 |
| JP | 2003-298344 | 10/2003 |

OTHER PUBLICATIONS

Search Report dated Jan. 3, 2005 for European Patent Application No. EP 04 02 6803.

* cited by examiner

*Primary Examiner*—HoangAnh Le
(74) *Attorney, Agent, or Firm*—Brink Hofer Gilson & Lione

(57) ABSTRACT

An antenna device includes a radiating conductor plate made of a metal sheet having an outer appearance of a substantially square shape and arranged on a ground conductor with a predetermined distance therefrom; a feed pin extending from a feeding point of the radiating conductor plate and connected to a feeding circuit; and leg pieces extending from four points of an outer circumferential edge of the radiating conductor plate to support the radiating conductor plate in a state insulated from the ground conductor. The four leg pieces are offset by predetermined distances from midpoints of respective sides of the radiating conductor plate, thereby forming degenerative separating elements. As a result, the antenna device 10 can be operated as a circularly polarized wave antenna.

5 Claims, 3 Drawing Sheets

CIRCULARLY POLARIZED WAVE ANTENNA MADE OF SHEET METAL WITH HIGH RELIABILITY

This application claims the benefit of priority to Japanese Patent Application No. 2003-382705 filed on Nov. 12, 2003 and 2004-038450 filed on Feb. 16, 2004, herein incorporated by reference.

BACKGROUND OF THE INVENTION

1. Field of the Invention

The present invention relates to a circularly polarized wave antenna having a patch antenna structure suitable for being mounted on a vehicle or the like, and more particularly, to a circularly polarized wave antenna made of sheet metal, which leads to reduction in cost.

2. Description of the Related Art

A vehicle-mounted antenna has an advantage of transmission or reception being performed using circularly polarized wave signals, making it unnecessary to control polarized directions of waves even during movement of a vehicle. Therefore, a small circularly polarized wave antenna having a patch antenna structure has been widely used as such a vehicle-mounted antenna.

FIG. 6 is a plan view showing a conventional example representative of a circularly polarized wave antenna of this type (for example, see Japanese Unexamined Patent Application Publication No 2000-151261 (Page 2, FIG. 5)). In the antenna device 1 shown in FIG. 6, which is referred to as the circularly polarized wave antenna, a radiating conductor (a patch electrode) 3 is provided on one surface of a dielectric substrate 2 using metal film forming technique such as printing or the like, and a ground conductor (not shown) is provided on most of the other surface of the dielectric substrate 2. The radiating conductor 3 has a substantially square shape and is comprised of degenerative separation elements 4 and 5 which are formed by cutting out a pair of corners of the conductor opposite in phase to each other. One end of a feed pin 6 is passed through the dielectric substrate 2 and the ground conductor, and is soldered to a predetermined feeding point in the radiating conductor 3, and the other end of the feed pin 3 is connected to a feeding circuit (not shown).

In the antenna device 1 generally constructed as such, predetermined high-frequency signals are supplied to the radiating conductor 3 via the feeding pin 6, such that the radiating conductor 3 resonates to radiate radio waves. In the radiating conductor 3, the resonant length of the resonance mode, in the diagonal direction in which the degenerative separating elements 4 and 5 exist, is shorter than the resonant length of the resonance mode in another diagonal direction orthogonal to the diagonal line. Accordingly, the size (the cutout area) of the degenerative separation elements 4 and 5 is appropriately adjusted to set a phase difference of about 90 degrees between both resonant modes, such that a synthesized dominant mode of both the resonant modes is excited. This enables the antenna device 1 to operate as a circularly polarized wave antenna.

The aforementioned conventional circularly polarized wave antenna (antenna device 1) is constructed such that the radiating conductor 3 is provided on one surface of the dielectric substrate 2 and the feed pin 6 is connected to the radiating conductor 3. This construction has a problem in that the antenna device 1 of this type cannot be manufactured at a low cost because the dielectric substrate 2 with a small amount of dielectric loss is expensive. In addition, the process of forming the radiating conductor 3 using the metal film forming technique is also complicated. Particularly, when the resonant frequency is high, a dielectric material with an extremely small dielectric loss is required as a material of the dielectric substrate 2 in order to secure the efficiency of the antenna. In this case, the dielectric material is very expensive and results in high material cost. For example, when a circularly polarized wave antenna having a resonant frequency of 5.8 GHz for an electronic toll collection (ETC) system is manufactured utilizing the aforementioned technique, the antenna device may become extremely expensive.

SUMMARY OF THE INVENTION

The present invention has been made in consideration of the above problems of the prior art. It is therefore an object of the invention to provide a circularly polarized wave antenna with a patch antenna structure which can be manufactured at a low cost and has a high reliability.

In order to achieve the above object, the present invention provides a circularly polarized wave antenna comprised of the following: a radiating conductor plate made of a metal sheet having an outer appearance of a substantially regular polygonal or circular shape and is arranged on a ground conductor with a predetermined distance therefrom; a feed pin extending from a feeding point of the radiating conductor plate and connected to a feeding circuit; and leg pieces extending from four points of the radiating conductor plate to support the radiating conductor plate in a state insulated from the ground conductor. The four leg pieces are composed of first and second leg pieces that are brought relatively close to each other and third and fourth leg pieces that are brought relatively close to each other. Two straight lines pass through the center of the radiating conductor plate orthogonal to each other. The first and second leg pieces are arranged substantially in line symmetry with respect to one straight line while the third and fourth leg pieces are arranged substantially in line symmetry with respect to the one straight line. The first and third leg pieces are arranged substantially in line symmetry with respect to the other straight line while the second and fourth leg pieces are arranged substantially in line symmetry with respect to the other straight line. A straight line connecting the feeding point and the center of the radiating conductor plate forms an angle of about 45 degrees with respect to both of the two straight lines.

The circularly polarized wave antenna is constructed to have an offset arrangement in which the four leg pieces for supporting the radiating conductor plate are not disposed at regular intervals. The first and second leg pieces are brought relatively close to each other and the third and fourth leg pieces are brought relatively close to each other such that a predetermined difference can be produced in resonant length of two resonant modes orthogonal to each other. Specifically, the resonant length of a resonant mode along a symmetry axis of the first and second leg piece and third and fourth leg pieces is longer than the resonant length of a resonant mode along a symmetry axis of the first and third leg pieces and second and fourth leg pieces. Accordingly, the size and offset distance of each of the leg pieces is properly adjusted to set a phase difference of about 90 degrees between both of the resonant modes. This is done so that the antenna device can be operated as a circularly polarized wave antenna. In addition, since the radiating conductor plate, feed pin and four leg pieces can be all formed by pressing one metal sheet, the circularly polarized wave antenna can be manufactured at a very low cost since it is not necessary to use an expensive dielectric material. Further, in the circularly polarized wave antenna, the radiating conductor plate can be held in a stable posture by the four leg pieces and the characteristics of the antenna can be prevented from deteriorating due to unevenness of a dielectric material, unevenness in precision of a printed pattern, etc. Therefore, it is possible to easily ensure high reliability.

In the circularly polarized wave antenna constructed as such, preferably, the radiating conductor plate has an outer appearance of a substantially square shape whose two diagonal lines correspond to the two straight lines. In this case, the respective leg pieces are arranged at positions that are deviated from midpoints of respective sides of the radiating conductor plate having an outer appearance of a substantially square shape. In other words, the first and second leg pieces may be arranged at positions close to one end of one diagonal line of the square while the third and fourth leg pieces may be arranged at positions close to the other end of the diagonal line. As described above, if the radiating conductor plate is made of a metal sheet having an outer appearance of a substantially square shape, the design becomes quite easy and the punching and bending can be performed efficiently. Therefore, the manufacturing cost can be further reduced to provide a very inexpensive circularly polarized wave antenna.

As a specific construction method, the four leg pieces may extend respectively from the inside of cutouts that are cut out from the outer circumferential edge of the radiating conductor plate towards the center. As another specific construction method, a capacitor may be attached to tips of the four leg pieces. As an example in this case, the capacitor may be composed of a dielectric substrate whose top face is provided at four points with soldering lands and whose bottom face is provided with an earth electrode. The capacitor may be placed on the ground conductor in order to solder the tips of the four leg pieces onto the corresponding soldering lands.

Since the circularly polarized wave antenna of the present invention has an offset arrangement in which the four leg pieces for supporting the radiating conductor plate are not disposed at regular intervals, the four leg pieces serve as degenerative separating elements because a predetermined difference is produced in resonant length between two resonance modes of the radiating conductor plate orthogonal to each other. Further, since the radiating conductor plate, feed pin and four leg pieces can be all formed by pressing one metal sheet, it is unnecessary to use an expensive dielectric material. Accordingly, it is possible to provide a circularly polarized wave antenna manufactured at a very low cost with high reliability.

DESCRIPTION OF THE PREFERRED EMBODIMENTS

Figure 1:
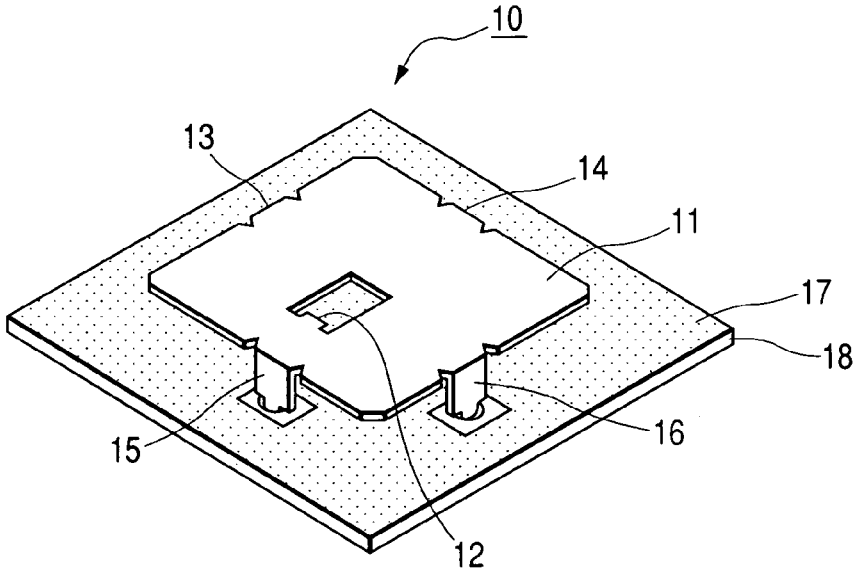
FIG. 1 is a perspective view of an antenna device according to a first embodiment of the present invention.
Figure 2:
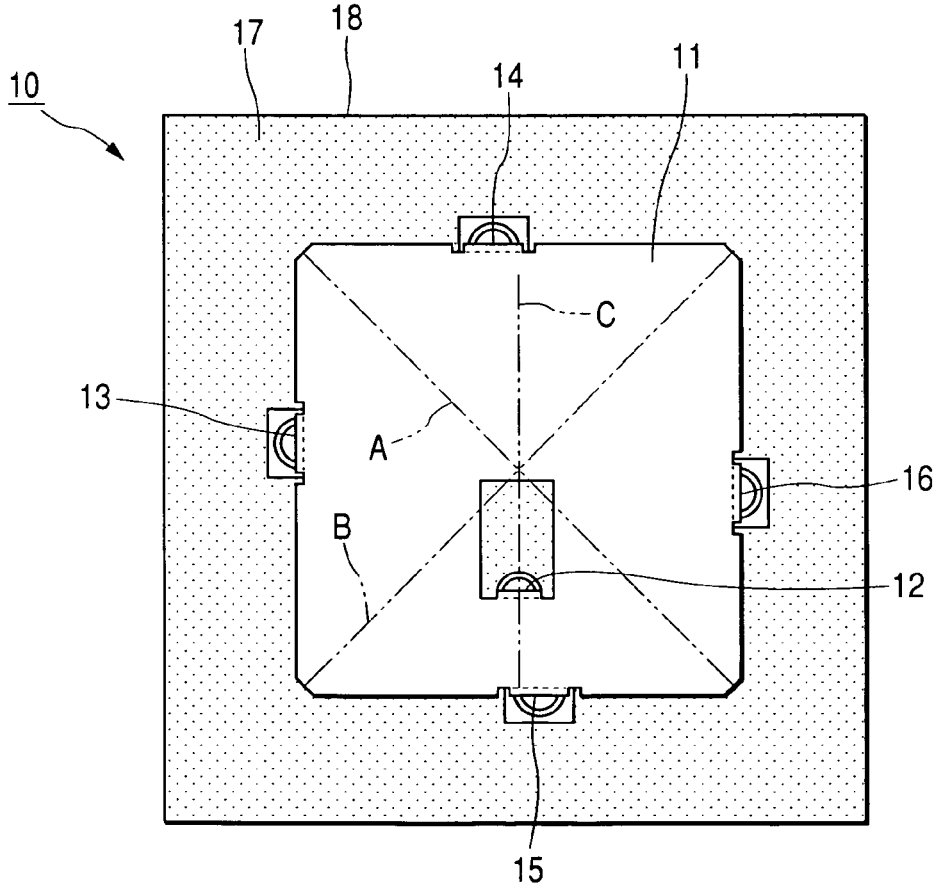
FIG. 2 is a plan view of the antenna device in FIG. 1.

Now, preferred embodiments of the present invention will be described with reference to the accompanying drawings. FIG. 1 is a perspective view of an antenna device (circularly polarized antenna) according to a first embodiment of the present invention; FIG. 2 is a plan view of the antenna device; and FIG. 3 is a sectional view of the antenna device.

Figure 3:
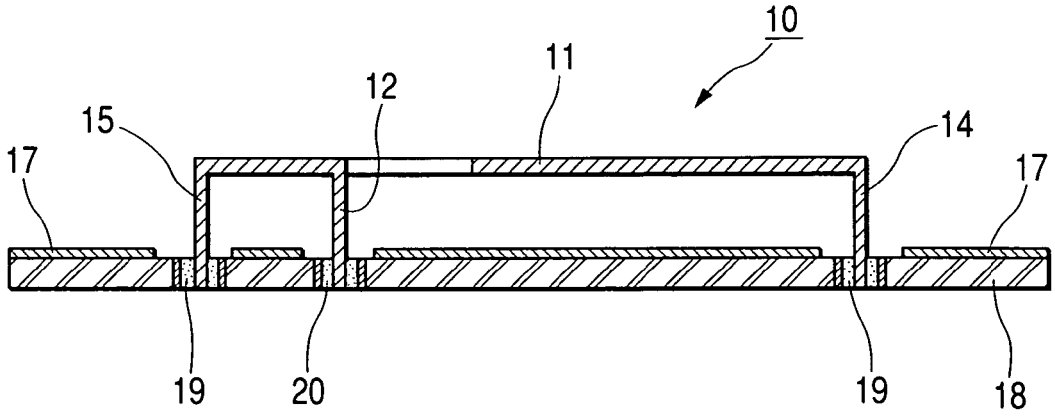
FIG. 3 is a sectional view of the antenna device in FIG. 1.

An antenna device 10 shown in FIGS. 1 to 3 are comprised of a radiating conductor plate 11, a feed pin 12 and four leg pieces 13 to 16. These are all formed by pressing one metal sheet, and then are placed on and fixed to the substrate 18 on the top face of which a ground conductor 17 is provided. The radiating conductor plate 11 has an outer appearance of a substantially square shape and has the leg pieces 13 to 16 extending downward from the outer circumferential edge. The leg pieces 13 to 16 are formed by bending tongue pieces provided at four points of the circumferential portion of the radiating conductor plate 11 at right angles toward the substrate 18. Lower ends of the respective leg pieces 13 to 16 are inserted into and soldered to the corresponding mounting holes 19 of the substrate 18. As apparent from FIG. 3, the respective leg pieces 13 to 16 are insulated from the ground conductor 17 to form electrical open terminals. Also, the four leg pieces 13 to 16 are mechanically fixed to the substrate 18 and allow the radiating conductor plate 11 to be maintained in a posture substantially parallel to the ground conductor 11. Further, a feed pin 12, which is formed by cutting and erecting the radiating conductor plate 11 at a feeding point, extends downward, and is soldered in a through-hole 20 of the substrate 18. As a result, since the feed pin 12 is connected to a feeding circuit (not shown) provided on the bottom face of the substrate 18, a predetermined high frequency signal can be supplied to the radiating conductor plate 11 via the feed pin 12.

The antenna device 10 is characterized by a relative positional relationship between the four leg pieces 13 to 16 that support the radiating conductor plate 11. The respective leg pieces 13 to 16 are not arranged at regular intervals. Specifically, the first and second leg pieces 13 and 14 of the four leg pieces 13 to 16 are arranged relatively closer to each other, and arranged substantially in line symmetry with respect to the diagonal line 'A' of the radiating conductor plate 11. The third and fourth leg pieces 15 and 16 are arranged relatively closer to each other, and both of the leg pieces 15 and 16 are also arranged substantially in line symmetry with respect to the diagonal line 'A'. In other words, the first and second leg pieces 13 and 14 are arranged at positions close to one end of the diagonal line 'A' while the third and fourth leg pieces 15 and 16 are arranged at positions biased toward the other end of the diagonal line 'A'. Further, the first and third leg pieces 13 and 15 are arranged substantially in line symmetry with respect to the other diagonal line 'B' of the radiating conductor plate 11 while the second and fourth leg pieces 14 and 16 are arranged substantially in line symmetry with respect to the diagonal line 'B'. Therefore, the distance from the opposite ends of the diagonal line 'B' to the neighboring leg pieces is longer than the distance from the opposite ends of the diagonal line 'A' to the neighboring leg pieces. Moreover, a straight line 'C' which connects the center of the radiating conductor plate 11 with the feed pin 12 is set to form an angle of about 45 degrees with respect to both of the diagonal lines 'A' and 'B'.

In the antenna device 10, as described above, the respective leg pieces 13 to 16 protruding from the outer circumferential edge of the radiating conductor plate 11 are arranged at positions offset by predetermined distances from midpoints of respective sides of the radiating conductor plate 11. This is done such that the four leg pieces 13 to 16 are allowed to function as degenerative separation elements and produce predetermined difference in resonant length between two resonance modes of the radiating conductor plate 11 orthogonal to each other. Specifically, the resonant length of the resonance mode along the diagonal line 'A' is longer than the resonant length of the resonant mode along the diagonal line 'B'. The size and offset distance of each of the leg pieces 13 to 16 is properly adjusted in advance so that the phase difference between both of the resonant modes is set to be about 90 degrees. Therefore, the antenna device 10 can be operated as a circularly polarized wave antenna.

Further, since all of the radiating conductor plate 11, the feed pin 12 and the four leg pieces 13 to 16 can be formed by pressing one metal sheet, the antenna device 10 can be manufactured at a very low cost since it is not necessary to use an expensive dielectric material. Moreover, since the radiating conductor plate 11 of the antenna device 10 is made of a metal sheet having an outer appearance of a square shape, the design is easy and the punching and bending can be performed efficiently. Hence, the manufacturing cost can be further reduced.

Further, in the antenna device 10, the radiating conductor plate 11 can be held in a stable posture by the four leg pieces 13 to 16, and the characteristics of the antenna 10 can be prevented from deteriorating due to unevenness of a dielectric material, unevenness in precision of a printed pattern, etc. Therefore, it is possible to easily ensure high reliability.

Figure 4:
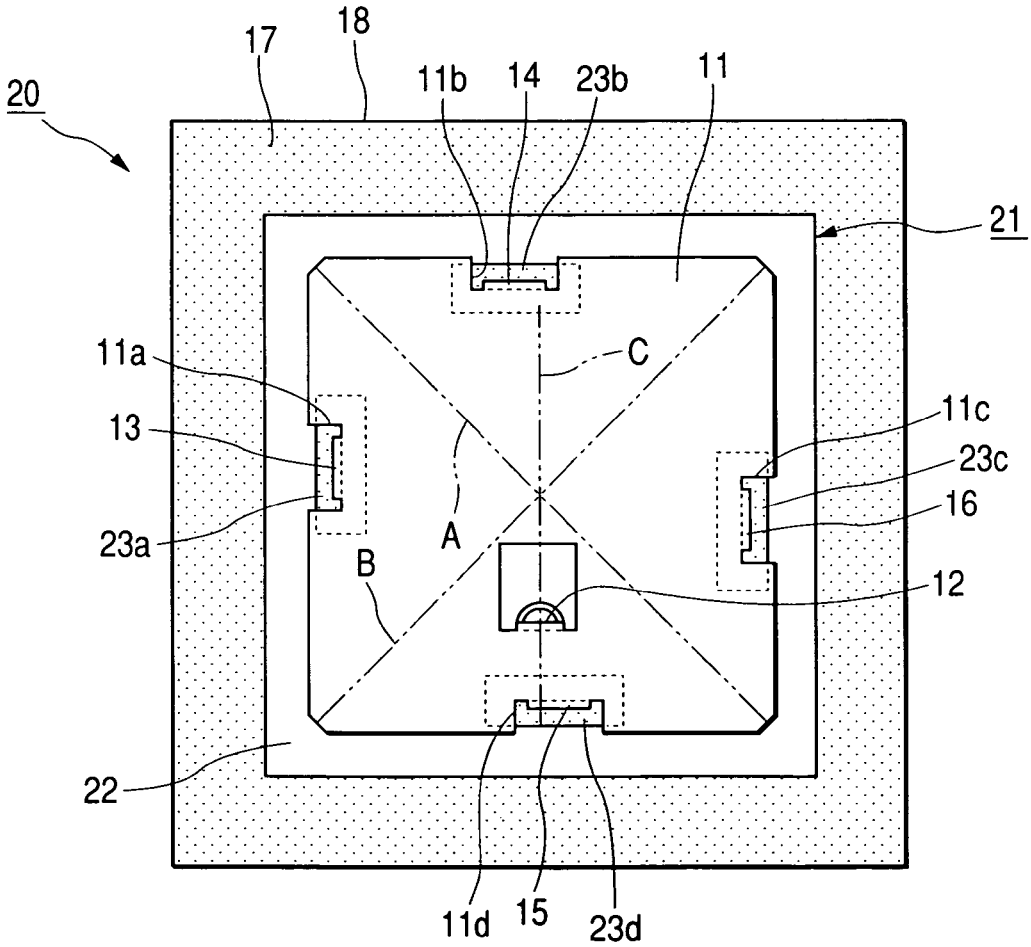
FIG. 4 is a plan view of an antenna device according to a second embodiment of the present invention.
Figure 5:
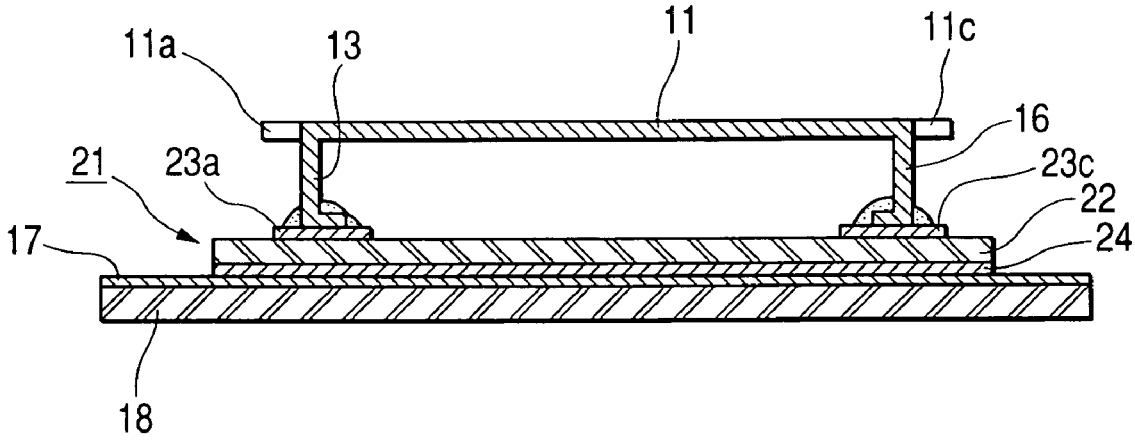
FIG. 5 is a sectional view of the antenna device in FIG. 5.
Figure 6:
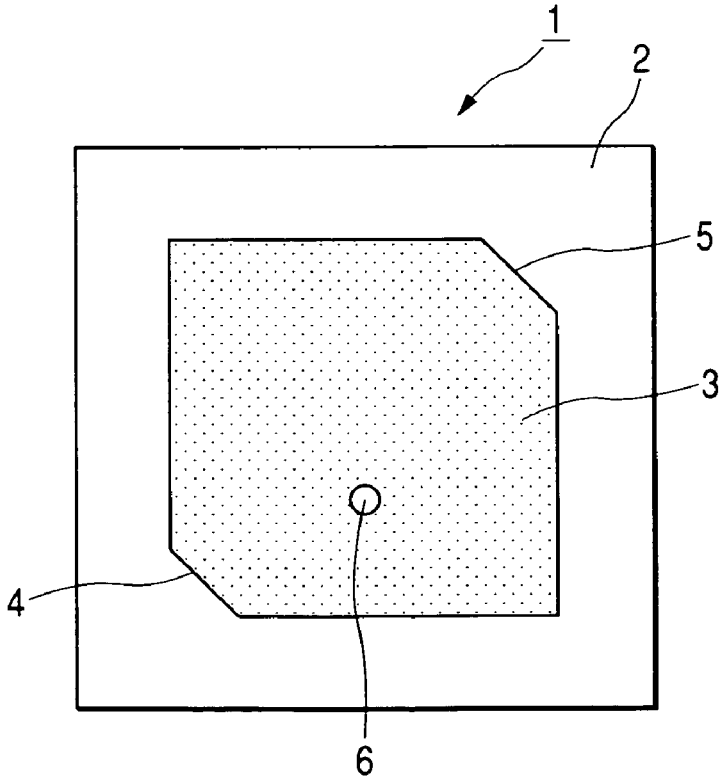
FIG. 6 PRIOR ART
FIG. 6 is a plan view of an antenna device according to a conventional example.

FIG. 4 is a plan view of an antenna device (circularly polarized wave antenna) according to a second embodiment of the present invention, and FIG. 5 is a sectional view of the antenna device in FIG. 4. The same reference numerals are given to parts in FIGS. 4 and 5 that correspond to those in FIGS. 1 to 3. The duplication of the description of those parts will be omitted.

In an antenna device 20 shown in FIGS. 4 and 5, four leg pieces 13 to 16 extend downward, respectively, from the insides of cutouts 11*a* to 11*d* that are cut out from the outer circumferential edge of the radiating conductor plate 11 toward the center of the plate. A capacitor 21 is attached to tips of the leg pieces 13 to 16. The capacitor 21 is constructed such that soldering lands 23*a* to 23*d* are soldered to a dielectric substrate 22 at four points on the top face, and an earth electrode 24 is provided on the bottom face of the dielectric substrate 22. The tips of the four leg pieces 13 to 16 are soldered onto the corresponding soldering lands 23*a* to 23*d*, whereby the radiating conductor plate 11 is placed on and fixed to the ground conductor 17 of the substrate 18 with the capacitor 21 interposed between them. In addition, a lower end of the feed pin 12 passes through the dielectric substrate 22, and is soldered in the through-hole 20 of the substrate 18.

In the antenna device 20 constructed as described above, the four leg pieces 13 to 16 extending toward the dielectric substrate 22 from the radiating conductor plate 11 are respectively mounted onto and soldered to the soldering lands 23*a* to 23*d*. However, the soldering lands 23*a* to 23*d* are opposed to the ground conductor 17 with the dielectric substrate 22 interposed therebetween. Thus, an additional capacitor (e.g., capacitor 21) is formed between the soldering lands 23*a* to 23*d* and the ground conductor 17. Accordingly, the resonant frequency of the radiating conductor plate 11 becomes low as compared to that in case that an additional capacitor does not exist. Hence, the size of the radiating conductor plate 11, which is required for resonating at a specified frequency, can be reduced. This is advantageous to make the antenna device small.

The aforementioned embodiments have respectively been described for the case where the radiating conductor plate 11 has an outer appearance of a substantially square shape. However, even if the radiating conductor plate has an appearance of a regular polygonal or circular shape, the four leg pieces extending from the outer circumferential edge of the radiating conductor plate are set to be an offset arrangement with irregular intervals, so that it is possible to make an antenna device functioning as a circularly polarized wave antenna at a low cost with and high reliability.

What is claimed is:

1. A circularly polarized wave antenna is comprised of:

a radiating conductor plate made of a metal sheet which has an outer appearance of a substantially regular polygonal or circular shape and is arranged on a ground conductor with a predetermined distance therefrom;

a feed pin extending from a feeding point of the radiating conductor plate and connected to a feeding circuit; and leg pieces extending from four points of the radiating conductor plate for supporting the radiating conductor plate in a state insulated from the ground conductor, wherein the four leg pieces including first, second, third, and fourth leg pieces, the first and second leg pieces closer to each other than to either the third or fourth leg pieces, and the third and fourth leg pieces closer to each other than to either the first or second leg pieces, and wherein, the first and second leg pieces are arranged substantially in line symmetry with respect to one straight line of two straight lines passing through the center of the radiating conductor plate orthogonal to each other, and the third and fourth leg pieces are arranged substantially in line symmetry with respect to the one straight line, the first and third leg pieces are arranged substantially in line symmetry with respect to the other straight line, and the second and fourth leg pieces are arranged substantially in line symmetry with respect to the other straight line, and a straight line connecting the feeding point and the center of the radiating conductor plate forms an angle of about 45 degrees with respect to both of the two straight lines.

2. The circularly polarized wave antenna according to claim 1, wherein the radiating conductor plate has an outer appearance of a substantially square shape whose two diagonal lines correspond to the two straight lines.

3. The circularly polarized wave antenna according to claim 1, wherein the four leg pieces extend respectively from an inside of cutouts cut out from an outer circumferential edge of the radiating conductor plate toward the center.

4. The circularly polarized wave antenna according to claim 1, wherein a capacitor is attached to tips of the four leg pieces.

5. The circularly polarized wave antenna according to claim 4, wherein the capacitor is composed of a dielectric substrate whose top face is provided at four points with soldering lands and whose bottom face is provided with an earth electrode, and the capacitor is placed on the ground conductor to solder the tips of the four leg pieces onto the corresponding soldering lands.

* * * * *